US005241143A

United States Patent [19]

Adams

[11] Patent Number: 5,241,143

[45] Date of Patent: Aug. 31, 1993

[54] DUAL CONTROL ELECTRIC OUTLET

[76] Inventor: Wilber R. Adams, P.O. Box 1644, Terre Haute, Ind. 47808

[21] Appl. No.: 954,471

[22] Filed: Sep. 30, 1992

[51] Int. Cl.[5] ..... H01R 19/28

[52] U.S. Cl. ..... 200/51.05; 200/51.07

[58] Field of Search ..... 200/51.03, 51.04, 51.05, 200/51.06, 51.07

[56] References Cited

U.S. PATENT DOCUMENTS

| | | | |
|---|---|---|---|
| 2,755,350 | 7/1956 | Fahlberg | 200/51.05 |
| 3,082,302 | 3/1963 | Rumble | 200/51.03 |
| 5,098,307 | 3/1992 | Francisco | 200/51.03 X |

*Primary Examiner*—Renee S. Luebke
*Attorney, Agent, or Firm*—H. John Barnett

[57] ABSTRACT

A duplex safety outlet which may be controlled from a wall switch, or remain energized, depending how the male plug is inserted into the outlet. A slidable circuit selection plate is disposed over the contacts of each outlet. The non-conducting selection plate is normally biased to a central position in which all of the electrical contacts of the outlet are covered. When the selection plate is pushed to the left, the prongs of a male plug can be inserted into the circuit which is connected to a wall switch. When the selection plate is moved to the right, the male plug can be inserted in a second circuit which remains energized at all times. Thus, the way the male plug is inserted in the outlet determines whether the outlet will be controlled from a wall switch, or whether it remains energized at all times. Each outlet can be operated separately, so one can be operated from the wall switch while the other is constantly energized, the reverse, or both the same.

14 Claims, 2 Drawing Sheets

DUAL CONTROL ELECTRIC OUTLET

BACKGROUND OF THE INVENTION

1. Field of the Invention

This invention relates to electrical outlets, and more particularly, to electrical outlets which include two alternate circuits and a slidable circuit selection plate. These outlets may be controlled from a nearby wall switch, or may remain energized, depending on the position of the male plug in the outlet. In addition, the slidable circuit selection plate returns to a safety position when the male plug is removed.

2. Description of the Related Art

The following patents relate to electrical receptacles and safety caps for electrical outlets:

| Patent Number | Inventor | Date |
|---|---|---|
| 4,094,569 | Dietz | 1978 |
| 4,168,104 | Buschow | 1979 |
| 4,240,686 | Kurbikoff | 1980 |
| 4,271,337 | Barkas | 1981. |

Dietz '569 describes a safety cube tap which employs a single resilient spring to bias a pair of adjacent protective plates to slide over the female receptacles in the cube tap. Buschow '104 discloses an electrical outlet having a ground prong activated gear mechanism which moves the slots in the safety plate into alignment with the slots of the outlet.

Kurbikoff '686 shows a triplex receptacle having vertically disposed grounded outlets which fit into a standard, single gang electrical receptacle box. The three outlets have a common ground, common neutral and common hot conductors. There is only one circuit common to all three receptacles, and there is no provision for controlling one or more of the circuits from a remote wall switch.

SUMMARY OF THE INVENTION

This invention is directed to a duplex safety outlet which may be controlled from a wall switch, or remain energized, depending how the male plug is inserted into the outlet. A slidable circuit selection plate is disposed over the contacts of each outlet. The non-conducting selection plate is normally biased to a central position in which all of the electrical contacts of the outlet are covered. When the selection plate is pushed to the left, the prongs of a male plug can be inserted into the circuit which is connected to a wall switch. When the selection plate is moved to the right, the male plug can be inserted in a second circuit which remains energized at all times. Thus, the way the male plug is inserted in the outlet determines whether the outlet will be controlled from a wall switch, or whether it remains energized at all times. The householder's convenience determines which way the male plug is inserted into the outlet. Each outlet can be operated separately, so one can be operated from the wall switch while the other is constantly energized, the reverse, both the same.

DESCRIPTION OF THE PREFERRED EMBODIMENT

Figure 1:
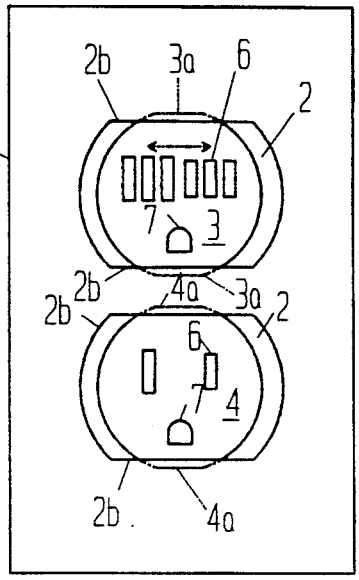
FIG. 1 is a front view with some parts omitted, and some parts shown in phantom showing a duplex outlet of the invention.
Figure 2:
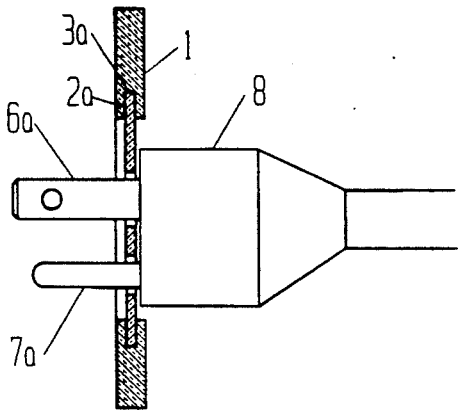
FIG. 2 is a side view, partly in section and with parts omitted, showing a standard, three prong male plug inserted into the slidable circuit selection plate of the invention.

As seen in FIG. 1, a cover plate 1 of a duplex outlet has a pair of slightly wider than normal plug openings 2. Open channels 2*a* are provided along the opposed horizontal surfaces 2*b* of the openings 2. Female receptacle face plates 3 and 4 are disposed with their horizontal edges 3*a* and 4*a* in the corresponding open channels 2*a* so that face plates 3 and 4 may slide horizontally, within the limits of openings 2.

In FIG. 1 the bottom duplex receptacle face plate 4 is shown in the middle safety position. The top receptacle face plate 3 includes phantom lines to show that the face plates 3 and 4 may be moved to any of three positions:

1) to control the circuit from the wall switch;
2) constantly energized; or
3) safety plate in position over the female receptacle.

The female receptacle face plates 3 and 4 each have slotted openings 6 and a hemicircular opening 7, through which the metal prongs 6*a* and 7*a* of male plug 8 extend when the face plate 3 or 4 is positioned over the contacts of the main body of the outlet.

Figure 3:
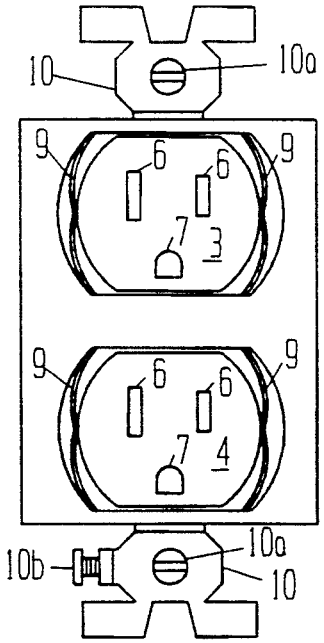
FIG. 3 is a schematic front view of the duplex outlet shown in FIG. 1, but with the cover plate removed.

As seen in FIG. 3, the face plates 3 and 4 are each provided with a pair of springs 9 to urge the face plates 3 and 4 to the central safety position when not in use. FIG. 3 also shows common ground strap 10 provided with screws 10*a* to mount the duplex outlet in a standard outlet box (not shown). Ground strap 10 has a terminal 10*b* to connect to ground.

Figure 4:
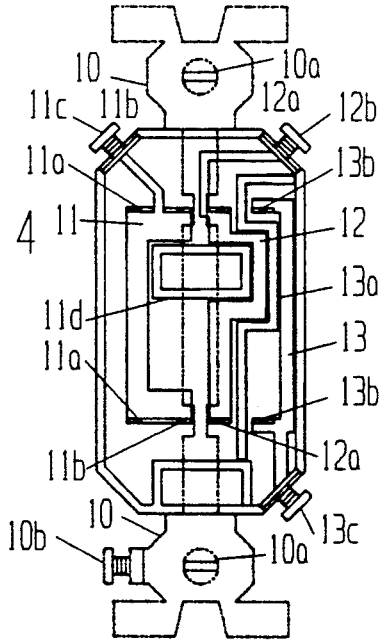
FIG. 4 is a schematic front view of the main body of the duplex outlet shown in FIG. 3.

FIG. 4 shows the main body of the duplex outlet. The common ground strap 10 is shown in phantom. Common neutral bar 11 extends vertically in the left side of the main body, and includes female contacts 11*a* and 11*b* to receive prongs 6*a* of a male plug 8 when the slotted openings 6 are aligned with the female contacts 11*a*. Also included at the upper left end of the common neutral bar 11 is a screw connector terminal 11*c* to which the power circuit is attached.

A first positive bar 12 is vertically disposed to the right of the common neutral bar 11, and includes female contacts 12*a* to receive the other prongs 6*a* of a male plug 8 when the female receptacle face plates 3 or 4 are urged to their respective left most positions. The first positive bar 12 also includes a screw connector terminal 12*b* at the upper right corner of the main body for connecting to the power circuit. Negative bar 11, ground prong 7*a*, and first positive bar 12 are insulated from each other by a non-conductor wall 11*d*.

A second positive bar 13 is vertically disposed to the right of the first positive bar 12. The positive bars 12 and 13 are insulated from each other by a non-conductor wall 13*a*. Female contacts 13*b* are included in the second positive bar 13 to receive the other prongs 6*a* of a male plug 8 when the female receptacle face plates 3 or 4 are urged to their respective right most positions.

The second positive bar 13 also includes a screw connector terminal 13*c* at the lower right corner of the main body for connecting to the power circuit.

Figure 5:
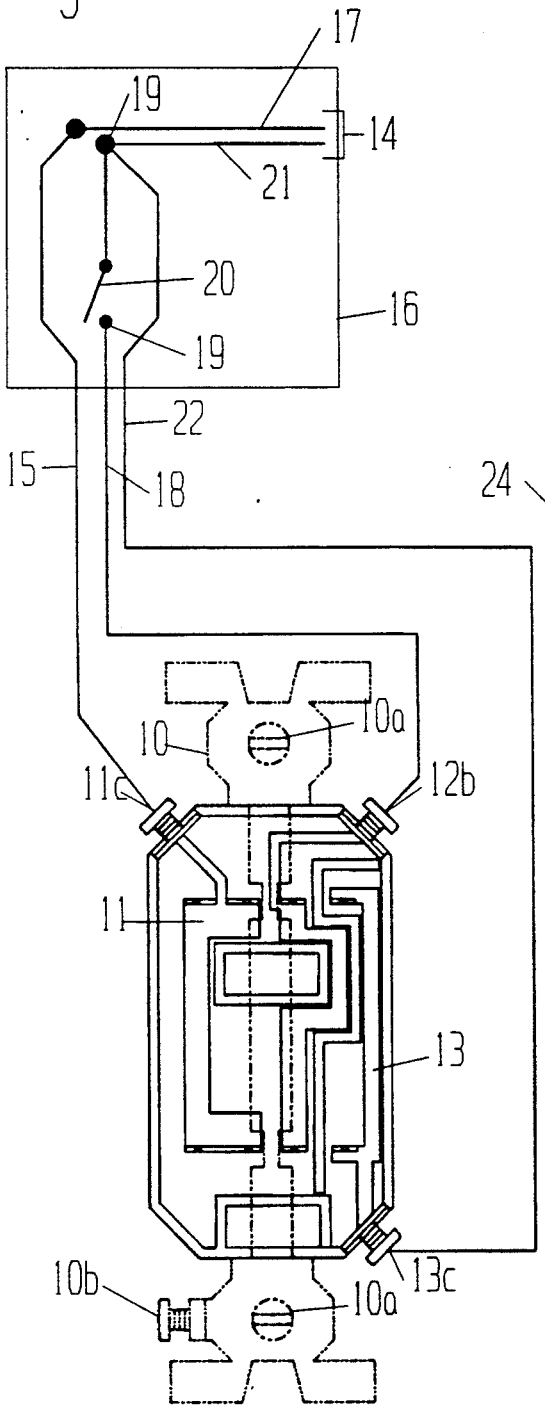
FIG. 5 is an electric circuit diagram showing two lines to the wall switch, and three lines direct to the duplex outlet, common ground not shown.

FIG. 5 shows a first embodiment of a power circuit 14 connected to the duplex outlet of the invention. Conductor 15 is the neutral line in the circuit and connects to the screw connector terminal 11*c* of the common neutral bar 11. The other end of conductor 15 connects in the switch box 16 to the neutral line 17 in the main power circuit.

Conductor 18 connects terminal 19 of wall switch 20 to the first positive bar 12 at the screw connector terminal 12*b*. Switch 20 operates to connect and disconnect conductor 18 to the positive line 21 of the main power circuit.

Conductor 22 connects directly to positive line 21 and by-passes wall switch 20 to connect at its other end to the second positive bar 13 through screw connector terminal 13*c*. The left position of male plug 8 causes its prongs 6*a* to be controlled by the position of wall switch 20. The right position of male plug 8 leaves it energized while plugged in, since the switch 20 is bypassed.

Figure 6:
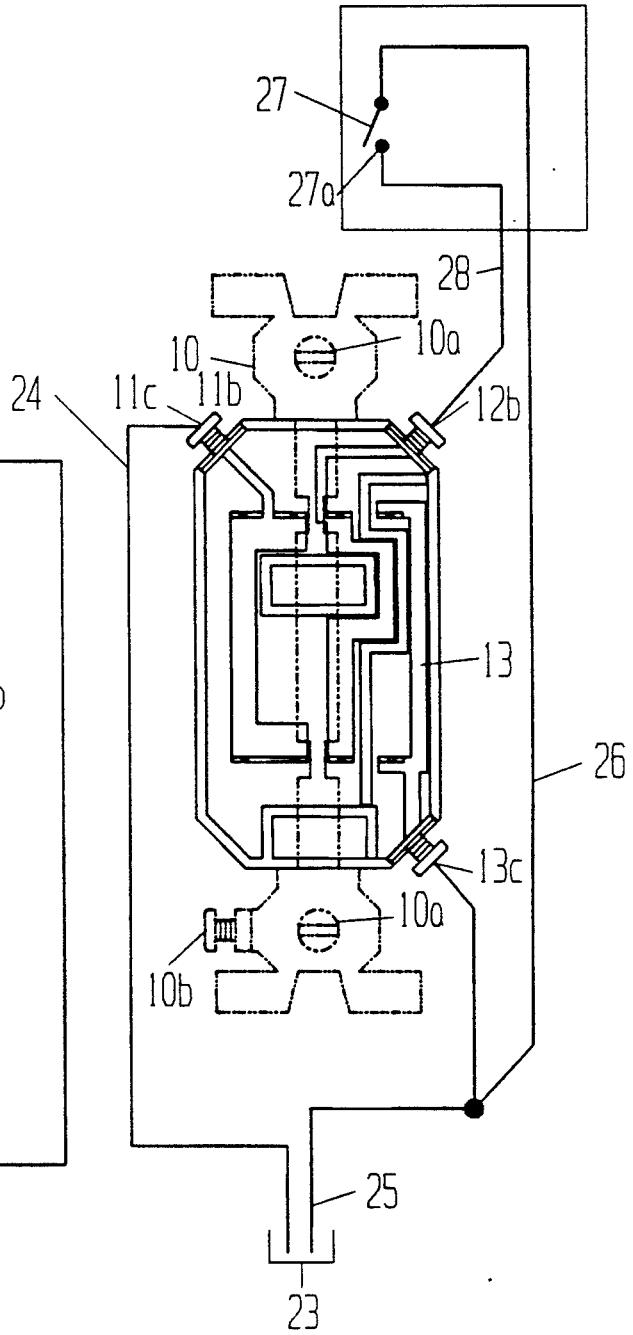
FIG. 6 is similar to FIG. 5 showing a circuit having two lines to the outlet, with one line to the switch, and back to the outlet, common ground not shown.

FIG. 6 shows another embodiment of a power circuit 23 in which only two conductors extend into the wall switch. As shown, neutral conductor 24 of the main power circuit connects directly to the screw connector terminal 11*c*. Positive line 25 of the main power circuit 23 connects directly to the screw connector terminal 13*c*, and is also connected by a first positive conductor 26 to a wall switch 27 having a terminal 27*a*. A second positive conductor 28 extends from the other side of terminal 27*a* to the screw connector terminal 12*b*.

When contacts 6*a* of male plug 8 are disposed in the left hand position, the outlet power is controlled by wall switch 27. When contacts 6*a* of male plug 8 are inserted in the outlet in the right hand position, power is supplied directly from the main power circuit.

The duplex outlet of this invention requires no substantial change in the main power circuit when installed. It only requires one extra wire when the main power circuit is wired directly to the wall switch. When the main power circuit is wired directly to the duplex outlet box, only two wires are required extending from the outlet box to the wall switch. In effect, the conductor bars 11, 12, 13 cooperate with the prongs 6*a* of the male plug 8 to select switch control operation or constant power operation of the duplex outlet.

What is claimed is:

1. An improved electric receptacle for receiving at least one male electric plug comprising:

a face plate having at least one outlet plug opening;

a movable, non-conducting circuit selection plate having first and second openings therein, said plate associated with an outlet plug opening;

first and third stationary female contact means disposed in the receptacle for receiving a first blade of a male electric plug extending through the first opening in the circuit selection plate;

second and fourth stationary female contact means disposed in the receptacle for selectively receiving a second blade of a male electric plug extending through the second opening in the circuit selection plate;

a first stationary electric circuit connected to the first and third stationary female contact means;

a wall switch connected in said first electric circuit to control electricity to the first and third stationary female contact means; and a second electric circuit connected to the second and fourth stationary female contact means which is energized at all times, whereby the position of the movable, non-conducting circuit selection plate determines whether a male plug makes contact with the first or second stationary electric circuit to be controllable from the wall switch, or constantly energized.

2. The electric receptacle of claim 1, including common stationary ground means for the first, second and third female contact means.

3. The receptacle of claim 1, in which the movable, non-conducting circuit selection plate is laterally movable, and has a safety position in which its openings are not aligned with either the first or second stationary circuits so that a male plug or any other object cannot be easily inserted into the receptacle.

4. The receptacle of claim 3, in which the non-conducting, movable circuit selection plate includes biasing means to normally bias the circuit selection plate to the safety position when no male plug is present.

5. The receptacle of claim 1, in which the third and fourth stationary female contact means comprise second and third generally parallel stationary positive connector bars, and the first and second stationary female contact means comprise first and second laterally displaced contact means on a common stationary neutral connecter bar, said common, second and third stationary connecter bars being of sufficient length to serve a plurality of male electric plugs.

6. The receptacle of claim 5, in which the common stationary neutral connecter bar is connected so that the neutral connecter bar can be part of either circuit.

7. The receptacle of claim 6, including a stationary common ground for each circuit.

8. An electric receptacle for connection of a plurality of male plugs, each having a pair of current conducting blades to a main power circuit comprising:

a cover plate having a plurality of slightly enlarged outlet openings, and having channels;

female non-conducting receptacle face plates slidably disposed in the channels in each of the outlet openings;

biasing means disposed on both sides of each receptacle face plate to urge the face plate to a central safety position when not in use;

a first, stationary neutral connecter bar connected to a stationary neutral conductor of an electric circuit mounted in the receptacle having a plurality of laterally spaced pairs of stationary female contacts for receiving the current conducting blades of a male plug to connect the male plug to the neutral conductor of an electric circuit;

a second, stationary positive connecter bar mounted in the receptacle, said bar having a plurality of stationary female contacts for receiving the other current conducting blade of the male plug to connect the male plug in circuit with a wall switch providing control of the circuit; and a third stationary connecter bar mounted in the receptacle, said third stationary connecter bar having a plurality of stationary female contacts which are continuously energized when one of the current conducting blades of the male plug connects the third connecter bar in an electric circuit;

whereby operation of the male plug is determined by positioning one current conducting blade of the male plug in contact with the second or third connecter bar and the other current conducting blade in contact with the first, stationary neutral connector bar with the associated female non-conducting receptacle face plate in alignment with the second or third stationary connector bars and the first, stationary neutral connecter bar.

9. The electric receptacle of claim 8, including a common stationary ground for the first, second and third stationary connecter bars.

10. The electric receptacle of claim 8, including insulation means between each of the second and third connecter bars and the common neutral connecter bar.

11. The electric receptacle of claim 10, in which the main power circuit is connected to the receptacle, the first, stationary neutral connecter bar is directly connected to the stationary neutral conductor of the main power circuit, and the positive conductor of the main power circuit is directly connected to the stationary second connecter bar, and to the wall switch, and the stationary third connecter bar is always energized, said circuit requiring only two wires from the receptacle to the wall switch, and two wires to the receptacle from the main power circuit.

12. The electric receptacle of claim 10, in which the main power circuit is connected to the wall switch, the common, stationary neutral connector bar is directly connected to the stationary neutral conductor of the main power circuit, and the positive conductor of the main power circuit is directly connected to the wall switch, and the wall switch is connected to the stationary second connecter bar and the stationary third connecter bar is always energized, said circuit requiring two wires to the wall switch from the main power circuit, and three wires from the wall switch to the receptacle, one of said wires bypassing the switch.

13. An improved electric receptacle for receiving at least one male electric plug comprising:

a face plate having at least one outlet plug opening;

a movable, non-conducting circuit selection plate having first and second openings therein, said plate associated with an outlet plug opening;

first and third stationary female contact means disposed in the receptacle for receiving a first blade of a male electric plug extending through the first opening in the circuit selection plate;

second and fourth stationary female contact means disposed in the receptacle for selectively receiving a second blade of a male electric plug extending through the second opening in the circuit selection plate;

a first stationary electric circuit connected to the first and third stationary female contact means;

a walls witch connected in said first electric circuit to control electricity to the first and third stationary female contact means;

a second electric circuit connected to the second and fourth stationary female contact means which is energized at all times, whereby the position of the movable, non-conducting circuit selection plate determines whether a male plug makes contact with the first or second stationary electric circuit to be controllable from the wall switch, or constantly energized; and including a plurality of channels in each face plate for slidably receiving the movable, non-conducting circuit selection plate.

14. The receptacle of claim 13, including spring means for resiliently biasing the circuit selection plate to a central safety position in which its openings are not aligned with any of the contact means.

* * * * *